US009080417B2

(12) United States Patent
Neer

(10) Patent No.: US 9,080,417 B2
(45) Date of Patent: Jul. 14, 2015

(54) DRILLABLE TOOL BACK UP SHOE

(75) Inventor: Adam Neer, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 582 days.

(21) Appl. No.: 13/447,859

(22) Filed: Apr. 16, 2012

(65) Prior Publication Data

US 2013/0269930 A1 Oct. 17, 2013

(51) Int. Cl.
*E21B 23/00* (2006.01)
*E21B 33/129* (2006.01)

(52) U.S. Cl.
CPC ..... *E21B 33/1292* (2013.01)

(58) Field of Classification Search
CPC . E21B 33/12; E21B 33/1208; E21B 33/1216; E21B 33/134
USPC ..... 166/118, 120, 134, 138, 387
See application file for complete search history.

(56) References Cited

U.S. PATENT DOCUMENTS

| | | | | |
|---|---|---|---|---|
| 3,659,647 | A * | 5/1972 | Brown | 166/120 |
| 4,304,299 | A * | 12/1981 | Holland et al. | 166/255.3 |
| 4,345,649 | A * | 8/1982 | Baugh et al. | 166/120 |
| 4,457,369 | A | 7/1984 | Henderson | |
| 4,664,188 | A | 5/1987 | Zunkel et al. | |
| 4,708,202 | A * | 11/1987 | Sukup et al. | 166/123 |
| 5,146,994 | A * | 9/1992 | Pleasants et al. | 166/387 |
| 5,857,520 | A | 1/1999 | Mullen et al. | |
| 6,581,681 | B1 * | 6/2003 | Zimmerman et al. | 166/135 |
| 7,373,973 | B2 | 5/2008 | Smith et al. | |
| 7,714,741 | B2 | 5/2010 | Snider et al. | |
| 8,191,625 | B2 * | 6/2012 | Porter et al. | 166/134 |
| 2011/0259610 | A1 * | 10/2011 | Shkurti et al. | 166/386 |

* cited by examiner

*Primary Examiner* — Kenneth L Thompson
*Assistant Examiner* — Michael Wills, III

(57) ABSTRACT

The invention relates to an improved downhole tool apparatus for limiting the extrusion of a sealing elements in downhole tools. The apparatus provides for using a limiter ring or shoe located in a channel on the slip wedge so as to abut the sealing element. The limiter ring extends outward to the casing to minimize the gap through which the sealing element can extrude when the tool is in a set position.

15 Claims, 6 Drawing Sheets

DRILLABLE TOOL BACK UP SHOE

BACKGROUND

The present invention relates to packer and bridge plug type tools used in wellbores and more particularly to limiter assemblies, which resist extrusion of packer elements when exposed to borehole conditions, especially high pressure and high temperature.

In the drilling or reworking of oil wells, a great variety of downhole tools are used. For example, but not by way of limitation, it is often desirable to seal tubing or other pipe in the casing of the well, such as when it is desired to pump cement or other slurry down the tubing and force the cement or slurry around the annulus of the tubing or out into a formation. It then becomes necessary to seal the tubing with respect to the well casing and to prevent the fluid pressure of the slurry from lifting the tubing out of the well or for otherwise isolating specific zones in a well. Downhole tools referred to as packers and bridge plugs are designed for these general purposes and are well known in the art of producing oil and gas.

Packers generally rely on a packer sealing assemblies to seal the wellbore. Traditionally such assemblies are comprised of at least one elastomeric sealing element and at least one mechanically set slip. Typically, a setting tool is run in with the packer to set it. The setting can be accomplished hydraulically due to relative movement created by the setting tool when subjected to applied pressure. This relative movement causes the slips to ride up on cones or wedges and extended into biting engagement with the surrounding casing or wellbore. At the same time, the sealing element is compressed into sealing contact with the surrounding casing or wellbore.

Packer element back-up shoes and rings have been employed to support the ends of the packer sealing elements as the elements are expanded into contact with a borehole wall. These back-up shoes or rings also may limit the axial extrusion of the packer sealing elements; thus they are sometimes called limiters or extrusion limiters. The shoes are typically segmented and, when the tool is set in a well, spaces between the expanded segments have been found to allow undesirable extrusion of the backer elements, at least in high pressure and high temperature wells. This tendency to extrude effectively sets the pressure and temperature limits for any given tool. Various improvements have been developed in ongoing efforts to prevent the extrusion of the packer elements between the segmented gaps and, while some have been effective to some extent, they have been complicated and expensive.

SUMMARY

The present invention provides a less complicated and expensive system of restraining the extrusion of the packer element by utilizing a simplified design to serve as a fixed extrusion limiter for a drillable tool. Additionally, the present invention does not suffer from the pressure and temperature limitations caused by the gaps in segmented limiters.

In one embodiment of the invention there is provided a downhole tool for use in a wellbore. The tool has a packer mandrel having a longitudinal axis. Disposed about the mandrel is an expandable sealing element, wherein the expandable sealing element is radially expandable outwardly from an unsealed position when the tool is in an unset position to a sealed position when the tool in a set position. In the sealed position, the expandable sealing element sealingly engages the wellbore. Additionally, the tool has a slip ring disposed about the mandrel and radially expandable outwardly from a disengaged position when the tool is in the unset position to an engaged position when the tool is in the set position, wherein the slip ring grippingly engages the wellbore in the engaged position. A slip wedge is disposed about the mandrel, having a radially outer surface containing a channel therein and an abutment end that abuts the expandable sealing element when the tool is in the set position. When the tool is moved from the unset position to the set position, the slip wedge interacts with the slip ring so as to expand the slip ring to its engaged position. A limiter ring is positioned in the channel of the slip wedge. When the tool is in the set position the limiter ring and the abutment end of the slip wedge act to retain the expandable sealing element and resist extrusion of the expandable sealing element.

In another embodiment of the invention there is provided a downhole tool for use in a wellbore. The tool has a packer mandrel having a longitudinal axis and an expandable sealing element disposed about the packer mandrel. The expandable sealing element is radially expandable outwardly from an unsealed position when the tool is in an unset position to a sealed position when the tool in a set position, and wherein the packer element assembly sealingly engages said wellbore in the sealed position. The tool also has a slip ring disposed about the mandrel. The slip ring is radially expandable outwardly from a disengaged position when the tool is in the unset position to an engaged position when the tool is in the set position. The slip ring grippingly engages the wellbore in the engaged position. A slip wedge is disposed about the mandrel. The slip wedge has a wedge portion having a generally conical shape with a first end having first outer radius and a second end having a second outer radius greater than said first outer radius. Additionally, the slip wedge has a back-up portion adjacent to the second end of the wedge portion. The back-up portion has a generally cylindrical shape with a third outer radius greater than the second outer radius and an abutment end that abuts the expandable sealing element when the tool is in the set position. The abutment end of the back-up portion acts to retain the expandable sealing element and resist extrusion of the expandable sealing element.

BRIEF DESCRIPTION OF THE DRAWINGS

FIG. 6 is a cross-sectional side view of a packer apparatus having a wedge in accordance with second embodiment of the present invention.

DETAILED DESCRIPTION

Figure 1:
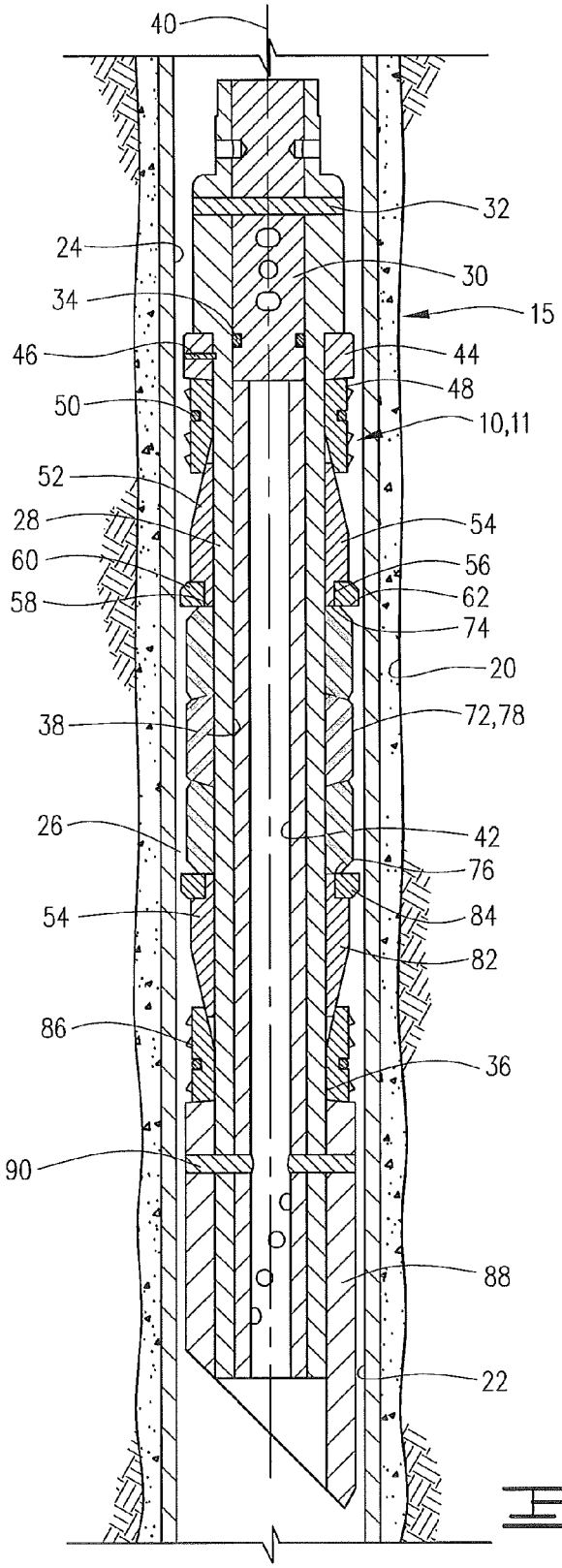
FIG. 1 is a cross-sectional side view of a packer apparatus in the unset position having a wedge and limiter ring in accordance with one embodiment of the present invention.

Referring now to FIGS. 1-4, downhole tool, or downhole apparatus 10 is shown in an unset position 11 in a well 15 having a wellbore 20. The wellbore 20 can be either a cased completion with a casing 22 cemented therein as shown in FIG. 1 or an openhole completion. Downhole apparatus 10 is shown in set position 13 in FIG. 2. Casing 22 has an inner surface 24. An annulus 26 is defined by casing 22 and downhole tool 10. Downhole tool 10 has a packer mandrel 28, and may be referred to as a bridge plug due to the downhole tool 10 having a plug 30 being pinned within packer mandrel 28 by radially oriented pins 32. Plug 30 has a seal means 34 located between plug 30 and the internal diameter of packer mandrel 28 to prevent fluid flow therebetween. The overall downhole tool 10 structure, however, is adaptable to tools referred to as packers, which typically have at least one means for allowing fluid communication through the tool. Packers may therefore allow for the controlling of fluid passage through the tool by way of one or more valve mechanisms which may be integral to the packer body or which may be externally attached to the packer body. Such valve mechanisms are not shown in the drawings of the present document. Packer tools may be deployed in wellbores having casings or other such annular structure or geometry in which the tool may be set.

Packer mandrel 28 has an outer surface 36, an inner surface 38, and a longitudinal central axis, or longitudinal axial centerline 40. Also, as referred to herein the term "radially" will refer to a radial direction perpendicular to the longitudinal axial centerline. An inner tube 42 is disposed in, and is pinned to, packer mandrel 28 to help support plug 30.

Figure 3:
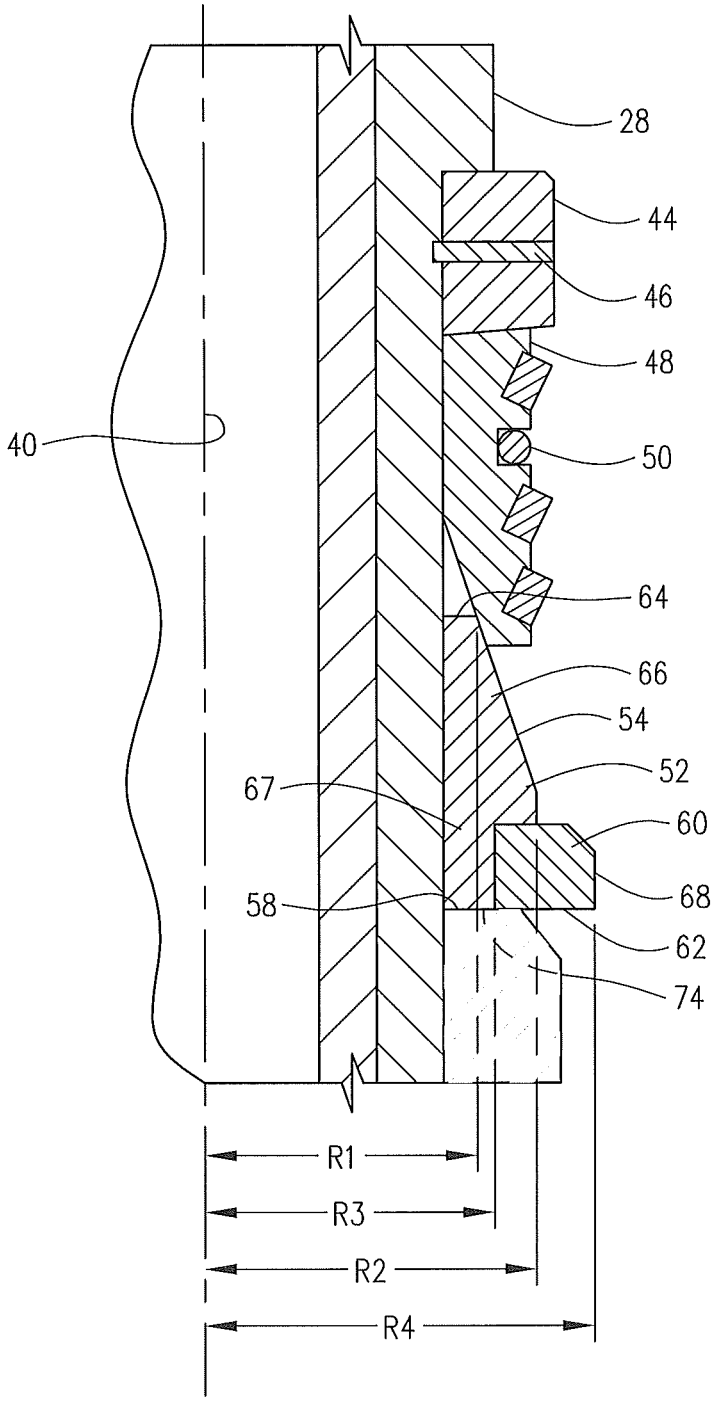
FIG. 3 is a cross-sectional side view of the upper right section of the packer apparatus illustrated in FIG. 1.
Figure 4:
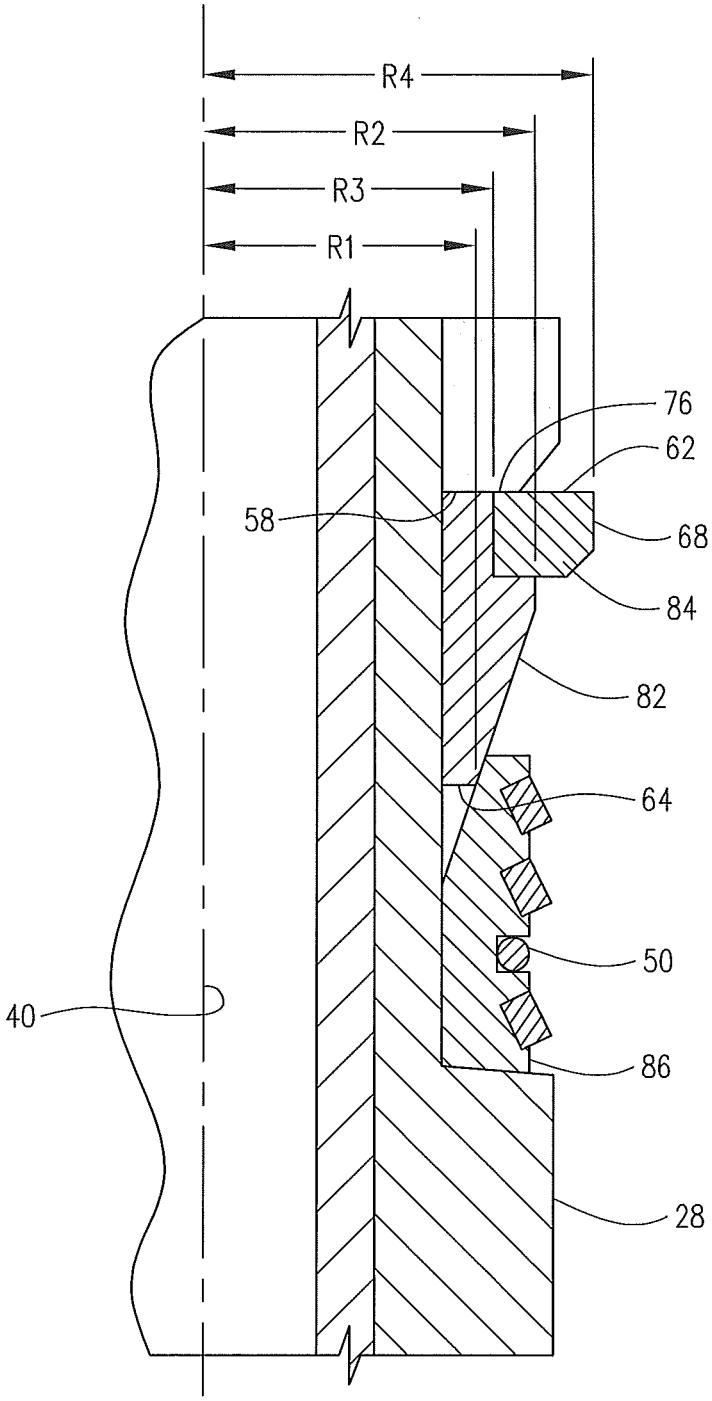
FIG. 4 is a cross-sectional side view of the lower right section of the packer apparatus illustrated in FIG. 1.

Downhole tool 10, which may also be referred to as packer apparatus 10, includes the usage of a spacer ring 44 which is preferably secured to packer mandrel 28 by pins 46. Spacer ring 44 provides an abutment, which serves to axially retain slip ring 48 which is positioned circumferentially about packer mandrel 28. Slip ring 48 may be composed of slip segments positioned circumferentially around packer mandrel 28 in order to form the slip ring 48. Slip retaining bands 50 serve to radially retain slip ring 48 in an initial circumferential position about packer mandrel 28 as well as slip wedge 52. Bands 50 are made of a steel wire, a plastic material, or a composite material having the requisite characteristics of having sufficient strength to hold the slip ring 48 in place prior to actually setting the downhole tool 10 and to be easily drillable when the downhole tool 10 is to be removed from the wellbore 20. Preferably, bands 50 are inexpensive and easily installed about slip ring 48. Slip wedge 52 is initially positioned in a slidable relationship to, and partially underneath, slip ring 48 as shown in FIGS. 1 and 3. Designs of slip ring 48 are described in U.S. Pat. No. 5,540,279, which is incorporated herein by reference.

Slip wedge 52 has a radially outer surface 54 containing a channel 56 therein. Additionally, slip wedge 52 has an abutment end 58 that abuts expandable sealing element 72, located below slip wedge 52. A limiter ring 60 is positioned in channel 56. Limiter ring 60 has abutment end 62 that abuts expandable sealing element 72. Limiter ring 60 is pressed into wedge 52 and can be held in place by frictional forces and/or adhesives. The limiter ring 60 can also serve to hold slip wedge 52 in place prior to setting the downhole tool.

As can be seen from FIG. 3, slip wedge 52 is designed as a partial cone with a first outer radius R1 at first end 64 and a second outer radius R2, wherein R2 is greater than R1. In one embodiment, slip wedge 52 has the wedge portion 66, preferably having a generally conical shape, and a tongue portion 67, preferably having a generally cylindrical shape. Tongue portion 68 has an outer radius R3, which is less than R2. In this embodiment, limiter ring 60 has an inner radius that is substantially equal to R3 and an outer radius R4 that is greater than R2. In a second embodiment, illustrated in FIG. 6, slip wedge 100 has a wedge portion 102 and a limiter portion or back-up portion 104 so that the limiter ring is an integral part of the slip wedge. In this second embodiment back-up portion 104 will preferably be generally cylindrical in shape and have an outer radius of R4.

Limiter ring 60 is design so that its outer surface 68 is close to inner surface 24 of casing 22 in order to minimize the gap between the two. Accordingly, the outer diameter of limiter ring 60 should be no more than 0.25 inch less than the inner diameter of the inner surface 24 to assure minimum extrusion of the expandable sealing element. In other words, outer radius R4 should be no more than 0.125 inches less than the radius of inner surface 24 when the tool is in the set position. Additionally, the outer diameter of ring 60 should be no less than 0.125 inch less than the inner diameter of inner surface 24 to assure adequate clearance during insertion of the tool in the wellbore. In other words, radius R4 should be no less than 0.0625 inch than the inner radius of inner surface 24 when the tool is in the unset position.

Figure 5:
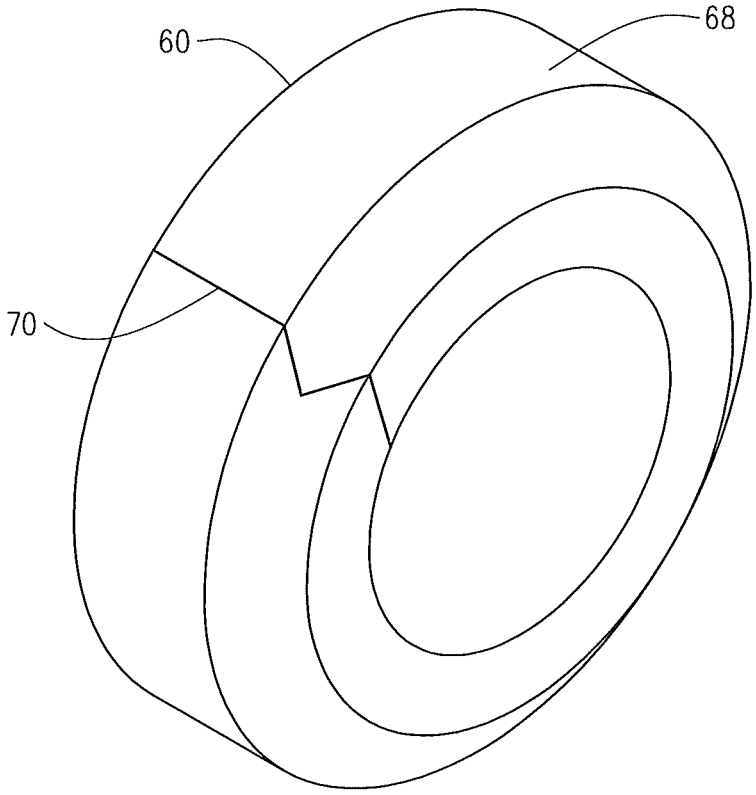
FIG. 5 is a perspective view of limiter ring in accordance with an embodiment of the present invention.
Figure 5:
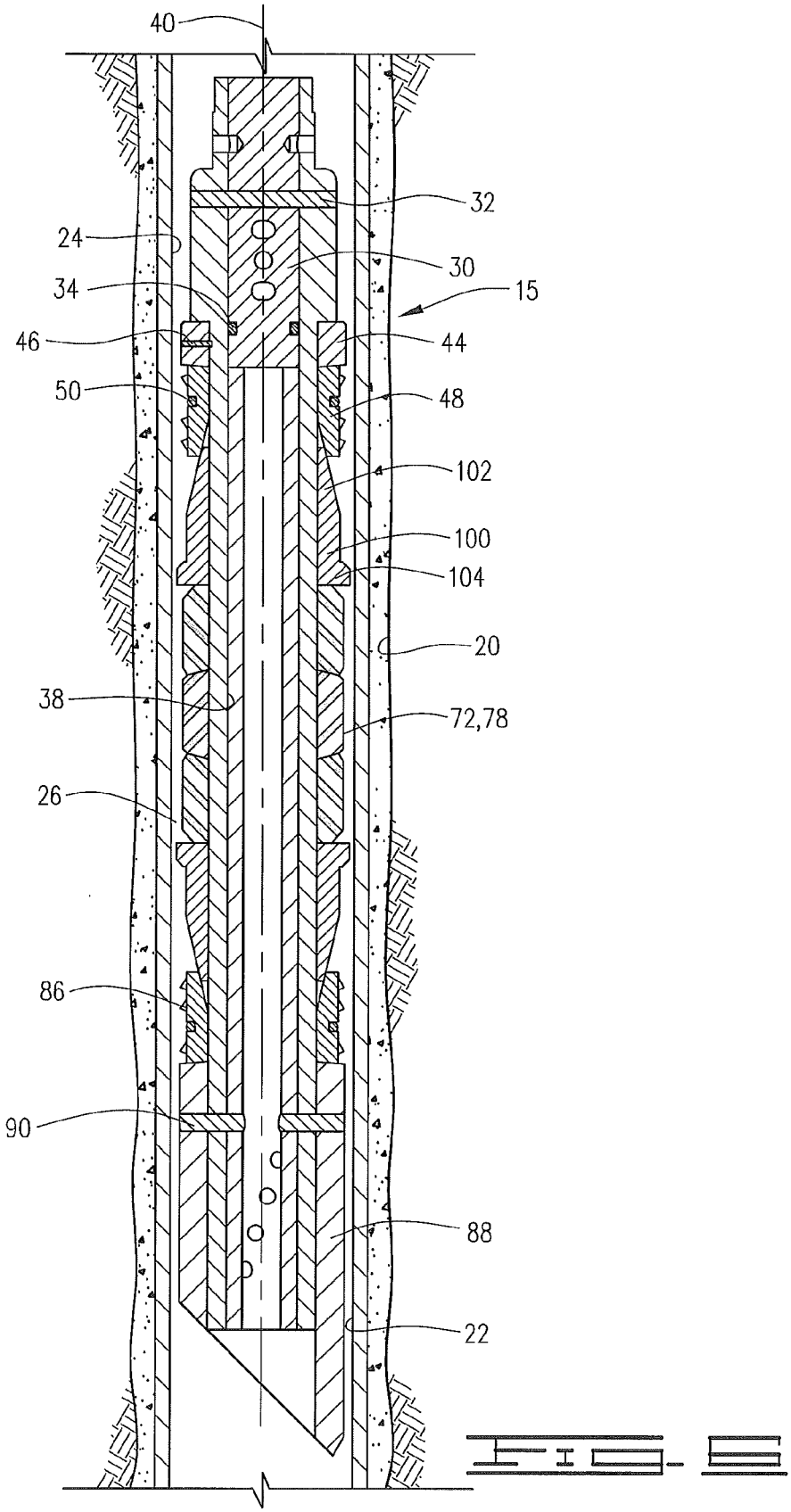

Limiter ring 60 can be a solid ring and applied to the downhole tool during assembly. In another embodiment, illustrated in FIG. 5, limiter ring 60 has an expansion joint 70, which allows the limiter ring to be installed after assembly of the downhole tool; that is after the spacer ring, slip rings, slip wedges and expandable sealing elements have been assembled on the packer mandrel. Expansion joint 70 can be a z-cut type joint.

Slip wedge 52 can be composed of composition material as is known in the art. Generally, limiter ring 60 can be made form any suitable material that will withstand the downhole use and yet can be readily cut or ground up by drilling with a drill bit. While limiter ring 60 may be composed of a similar material to slip wedge 52, generally limiter ring 60 will be formed from a material having a higher wear resistance such as brass or zirconia ceramic. Additionally, non-metallic engineering grade plastics can be used for the limiter ring, such as composite materials or structural phenolic materials. A suitable phenolic materials are available from General Plastics & Rubber Company, Inc., 5727 Ledbetter, Houston, Tex. 77087-4095. Alternatively, structural phenolics available from commercial suppliers may be used.

Located below slip wedge 52 is a expandable sealing element 72. The packer assembly of downhole tool 10 includes at least one such expandable sealing element, as shown in the figures, but may include two, three or more such expandable sealing elements. Expandable sealing element 72 has upper end 74 and lower end 76. Expandable sealing element 72 has unset and set positions 78 (FIG. 1) and 80 (FIG. 2) corresponding to the unset and set positions 11 and 13, respectively, of downhole tool 10. The expandable sealing element 72 is radially expandable from the unset position 78 to a set position 80 in response to the application of axial force on the expandable sealing element 72. Preferably, in unset position 78, expandable sealing element 72 has an unset radius that is less than the outer radius R4 of limiter ring 60. Also preferably, in set position 80, expandable sealing element 72 has a set radius that is greater than outer radius R4 of limiter ring 60. In the set position 80 the expandable sealing element 72 engages the wellbore 20 to create a seal to prevent flow through annulus 26.

Figure 2:
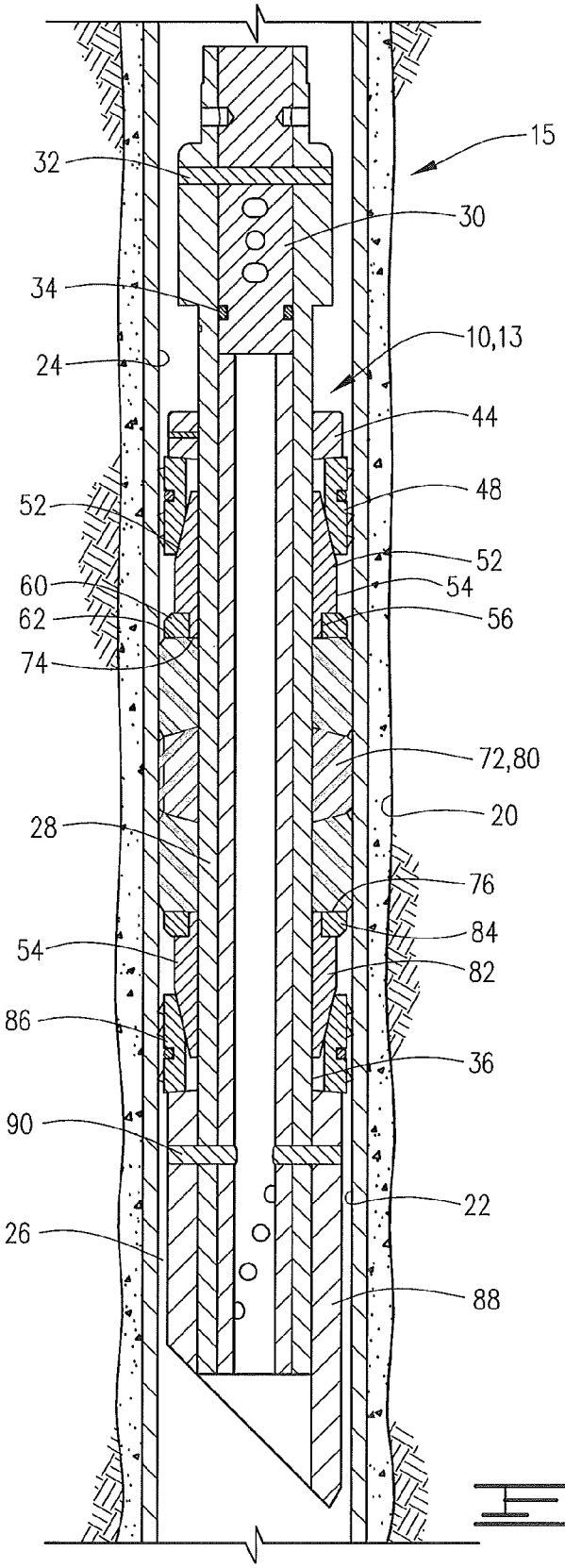
FIG. 2 is a cross-sectional side view of the packer apparatus of the embodiment of FIG. 1 in the set position.

Slip wedge 52 and limiter ring 60 are disposed at the upper end 74 of expandable sealing element 72. There is a second slip wedge 82 and limiter ring 84 disposed at the lower end 76 of expandable sealing element 72. Slip wedge 82 and limiter ring 84 are similar to slip wedge 52 and limiter ring 60; accordingly, like parts have been given the same reference numerals. As shown in FIGS. 1, 2 and 3 upper end 74 of expandable sealing element 72 resides directly against the abutting ends of upper slip wedge 52 and upper limiter ring 60. Additionally, lower end 76 of expandable sealing element 72 reside directly against lower slip wedge 82 and lower limiter ring 84. Thus, as illustrated in FIG. 2, by minimizing the gap between the outer surface 68 and the casing 22, the upper and lower limiter rings retain the expandable sealing element in the set position and limit extrusion of the expandable sealing element; generally, this will be axial extrusion. Thus, the current limiter rings and slip wedges provide for a fixed extrusion limiter as opposed to the complex expanding extrusion limiter systems of prior art.

Located below slip wedge 82 is slip ring 86. Slip wedge 82 and slip ring 86 are like slip wedge 52 and slip ring 48. At the lowermost portion of downhole tool 10 is an angled portion, referred to as mule shoe 88, secured to packer mandrel 28 by pin 90. The lowermost portion of downhole tool 10 need not be mule shoe 88 but can be any type of section which will serve to terminate the structure of the downhole tool 10 or serve to connect the downhole tool 10 with other tools, a valve or tubing, etc. It will be appreciated by those in the art that pins 32, 46 and 79, if used at all, are preselected to have shear strengths that allow for the downhole tool 10 to be set and deployed and to withstand the forces expected to be encountered in the wellbore 20 during the operation of the downhole tool 10.

Although the disclosed invention has been shown and described in detail with respect to a preferred embodiment, it will be understood by those skilled in the art that various changes in the form and detailed area may be made without departing from the spirit and scope of this invention as claimed. Thus, the present invention is well adapted to carry out the object and advantages mentioned as well as those which are inherent therein. While numerous changes may be made by those skilled in the art, such changes are encompassed within the spirit of this invention as defined by the appended claims.

What is claimed is:

1. A downhole tool for use in a wellbore, comprising:

a packer mandrel having a longitudinal axis;

an expandable sealing element disposed about said packer mandrel, wherein said expandable sealing element is radially expandable outwardly from an unsealed position when said tool is in an unset position to a sealed position when said tool in a set position, and wherein said expandable sealing element sealingly engages said wellbore in said sealed position;

a slip ring disposed about the mandrel and radially expandable outwardly from a disengaged position when said tool is in said unset position to an engaged position when said tool is in said set position, wherein said slip ring grippingly engages the wellbore in said engaged position;

a slip wedge disposed about the mandrel, having a radially outer surface containing a channel therein and an abutment end that abuts said expandable sealing element when said tool is in the set position; wherein when said tool is moved from said unset position to said set position, said slip wedge interacts with said slip ring so as to expand said slip ring to its engaged position;

a limiter ring positioned in said channel, wherein said limiter ring holds said slip wedge in place around said mandrel when said tool is in said unset position, and wherein when the tool is in said set position said limiter ring and said abutment end of said slip wedge act to retain said expandable sealing element and resist extrusion of said expandable sealing element.

2. The downhole tool of claim 1 wherein said channel is located adjacent to abutment end of said slip wedge.

3. The downhole tool of claim 1 wherein, when said limiter ring has an abutment end that abuts said expandable sealing element packer element.

4. The downhole tool of claim 1 wherein said limiter ring is comprised of a material selected from brass, zirconia ceramic, non-metallic engineering grade plastics, and mixtures thereof.

5. The downhole tool of claim 1 wherein said limiter ring is bonded to said slip ring by an adhesive.

6. The downhole tool of claim 1 wherein said limiter ring has an expansion joint such that said limiter ring can be installed on said downhole tool after said expandable sealing element, said slip ring and said slip wedge have been installed on said mandrel.

7. The downhole tool of claim 6 wherein said expansion joint is a z-cut.

8. A downhole tool for use in a wellbore, comprising:

a packer mandrel having a longitudinal axis;

an expandable sealing element disposed about said packer mandrel, wherein said expandable sealing element is radially expandable outwardly from an unsealed position when said tool is in an unset position to a sealed position when said tool in a set position, and wherein said expandable sealing element sealingly engages said wellbore in said sealed position;

a slip ring disposed about the mandrel and radially expandable outwardly from a disengaged position when said tool is in said unset position to an engaged position when said tool is in said set position, wherein said slip ring grippingly engages the wellbore in said engaged position;

a slip wedge disposed about the mandrel, having a radially outer surface containing a channel therein and an abutment end that abuts said expandable sealing element, wherein said channel is located adjacent to said abutment end and wherein when said tool is moved from said unset position to said set position, said slip wedge interacts with said slip ring so as to expand said slip ring to its engaged position;

a limiter ring positioned in said channel and bonded to said slip wedge by an adhesive, wherein said limiter ring has an expansion joint such that said limiter ring can be installed on said downhole tool after said expandable sealing element, said slip ring and said slip wedge have been installed on said mandrel and wherein said limiter ring has an abutment end that abuts said expandable sealing element such that when the tool is in said set position said abutment end of said slip wedge and said abutment end of said limiter ring act to retain said expandable sealing element and resist extrusion of said expandable sealing element.

9. A downhole tool for use in a wellbore, comprising:

a packer mandrel having a longitudinal axis;

an expandable sealing element disposed about said packer mandrel, wherein said expandable sealing element is radially expandable outwardly from an unsealed position when said tool is in an unset position to a sealed position when said tool in a set position, and wherein expandable sealing element sealingly engages said wellbore in said sealed position;

a slip ring disposed about the mandrel and radially expandable outwardly from a disengaged position when said tool is in said unset position to an engaged position when said tool is in said set position, wherein said slip ring grippingly engages the wellbore in said engaged position;

a slip wedge disposed about the mandrel, having a wedge portion having a generally conical shape with a first end having first outer radius and a second end having a second outer radius greater than said first outer radius and a back-up portion adjacent to said second end; said back-up portion having a generally cylindrical shape with a third outer radius greater than said second outer radius and an abutment end that abuts said expandable sealing element when said tool is in the said set position; wherein said abutment end of said back-up portion acts to retain said expandable sealing element wherein said expandable sealing element has outer unset radius and an outer set radius greater than said outer unset radius and wherein said third outer radius of said back-up portion of said slip wedge is greater than said outer unset radius and is less than said outer set radius and resist extrusion of said expandable sealing element and wherein said back-up portion holds said slip wedge in place around said mandrel when said tool is in said unset position.

10. The downhole tool of claim 9 wherein said back-up portion is comprised of a material selected from brass, zirconia ceramic and mixtures thereof.

11. The downhole tool of claim 9 wherein said back-up portion and said wedge portion are integral parts of said slip wedge.

12. The downhole tool of claim 9 wherein said wedge portion further comprises a generally cylindrical tongue portion having a fourth outer radius less than said third outer radius and said back-up portion has an inner radius substantially equal to said fourth outer radius such that said back-up portion fits over said tongue portion.

13. The downhole tool of claim 12 wherein said back-up portion is comprised of a material selected from brass, zirconia ceramic and mixtures thereof.

14. The downhole tool of claim 12 wherein said back-up portion has an expansion joint such that said back-up portion can be installed on said tongue portion after said expandable sealing element, said slip ring and said slip wedge have been installed on said mandrel.

15. The downhole tool of claim 14 wherein said expansion joint is a z-cut.

* * * * *